US005701933A

United States Patent [19]

Lunzman

[11] Patent Number: 5,701,933

[45] Date of Patent: Dec. 30, 1997

[54] HYDRAULIC CONTROL SYSTEM HAVING A BYPASS VALVE

[75] Inventor: Stephen V. Lunzman, Chillicothe, Ill.

[73] Assignee: Caterpillar Inc., Peoria, Ill.

[21] Appl. No.: 672,181

[22] Filed: Jun. 27, 1996

[51] Int. Cl.[6] ..... F15B 13/08

[52] U.S. Cl. ..... 137/596.12; 91/450

[58] Field of Search ..... 137/596.12; 91/450

[56] References Cited

FOREIGN PATENT DOCUMENTS 0 451 274 10/1991 European Pat. Off. .

*Primary Examiner*—Gerald A. Michalsky
*Attorney, Agent, or Firm*—Calvin E. Glastetter

[57] ABSTRACT

A hydraulic control system has a closed center control valve disposed to control flow of pressurized fluid from a pump to an actuator and a bypass valve disposed to control fluid flow through a bypass line connecting the pump to a reservoir. A controller connected to the control valve and the bypass valve is operative to controllably move the control valve toward an open, flow communicating position and the bypass valve toward a closed flow blocking position. A pressure compensating valve is disposed in the bypass line to maintain a predetermined pressure differential across the bypass valve when the pressure upstream of the bypass valve exceeds a predetermined level so that the flow through a area opening in the bypass valve is substantially commensurate with the opening at pressures above the predetermined level.

8 Claims, 1 Drawing Sheet

Fig. 2.
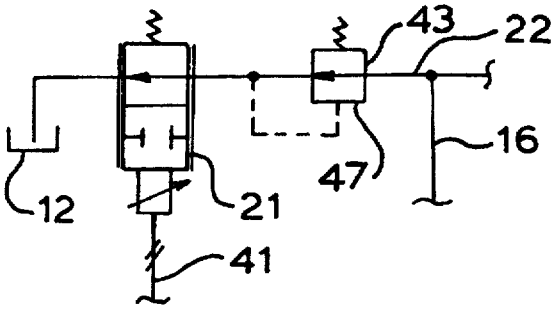
Fig. 1.
Fig. 3.
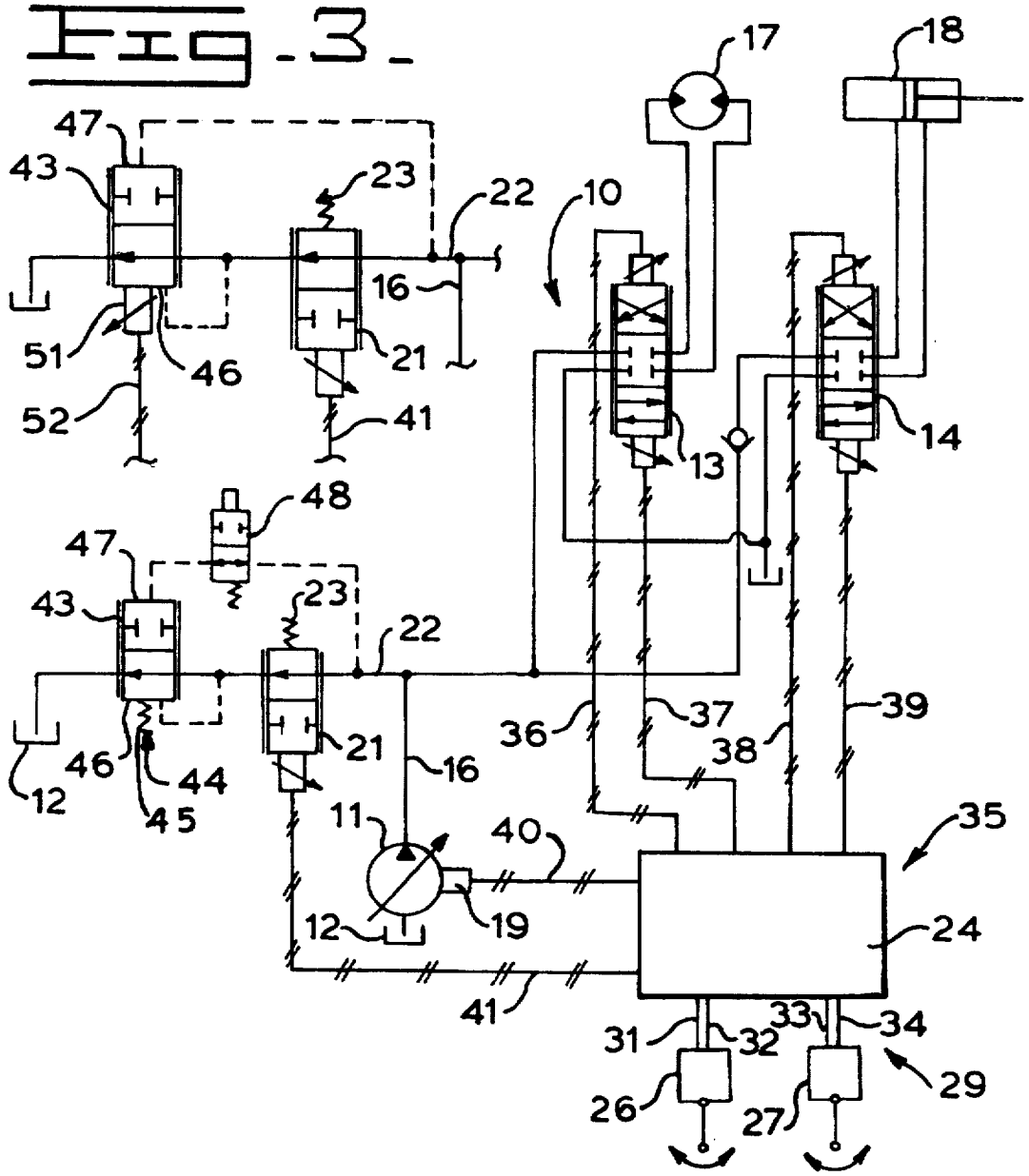

HYDRAULIC CONTROL SYSTEM HAVING A BYPASS VALVE

TECHNICAL FIELD

The present invention relates generally to a hydraulic control system and, more particularly, to one having a bypass valve in parallel with a plurality of closed center directional control valves.

BACKGROUND ART

Hydraulic control systems are utilized in construction machines such as hydraulic excavators, backhoe loaders, end loaders and so forth. Some known hydraulic control systems have a bypass valve disposed in parallel with a plurality of closed center directional control valves, all of which are controlled by a control unit. The area opening of the bypass valve is reduced in proportion to an increase in the area opening of one or more of the directional control valve in response to movement of a control lever.

One of the problems encountered with controlling the area opening of the bypass valve is that fluid flow through a given area opening varies with system pressure. Thus, the bypass flow through the bypass valve is greater at high system pressure than at low system pressure. Conversely, less fluid passes through the control valves to the cylinder at high system pressure than at low system pressure. This results in the cylinder speed not always matching the desired speed dictated by the position of the control lever.

Thus, it would be desirable to have a hydraulic control system having a bypass valve in parallel with a plurality of closed center directional valves with the bypass valve being controlled in order to provide control of bypass flow in combination with the bypass area opening. It would also be desirable to be able to operate the hydraulic system to provide either open center operating characteristics or closed center operating characteristics.

The present invention is directed to overcoming one or more of the problems as set forth above.

DISCLOSURE OF THE INVENTION

In one aspect of the present invention, a hydraulic control system has a pump for delivering pressurized hydraulic fluid from a reservoir and a closed center control valve disposed to control flow of pressurized fluid fed to the actuator from the pump. A bypass valve is disposed within a bypass line connecting the pump to the reservoir to control fluid flow therethrough and is biased to an open, flow communicating position. A controller connected to the control valve and the bypass valve is operative to controllably move the control valve toward an open flow communicating position and the bypass valve toward a closed flow blocking position. A pressure compensating valve is disposed in the bypass line to maintain a predetermined pressure differential across the bypass valve.

BRIEF DESCRIPTION OF THE DRAWINGS

FIG. 1 is a schematic illustration of an embodiment of the present invention; and FIGS. 2 and 3 are schematic illustrations of alternate embodiments of the present invention.

BEST MODE FOR CARRYING OUT THE INVENTION

A hydraulic control system 10 has a pump 11 connected to a reservoir 12 and to a pair of electrohydraulic proportional closed center directional control valves 13,14 through a supply conduit 16. The directional control valves 13,14 are suitably connected to a pair of actuators 17,18 respectively for controlling flow of pressurized hydraulic fluid fed thereto. The hydraulic pump 11 is a variable displacement pump and includes an electrohydraulic displacement controller 19. An electrohydraulic proportional bypass valve 21 is disposed in a bypass line 22 to control fluid flow therethrough from the supply conduit 16 to the reservoir 12. The bypass valve includes a spring 23 biasing the bypass valve to an open position as shown in the drawing.

The control system 10 also includes a controller in the form of a microprocessor 24 and a pair of manually operated command signal generating devices 26,27. The signal generating devices 26,27 provide a means 29 for controllably outputting a plurality of command signals 31–34 to the microprocessor to establish a desired fluid flow rate and direction of fluid flow through the directional control valves 13,14 either independently or in combination. The microprocessor 24 provides a control means 35 for processing the command signals, for producing a plurality of control signals 36–41 in response to the command signal, and for outputting the control signals 36–39 to the directional control valves, the control signal 40 to the displacement controller 19 and the control signal 41 to the bypass valve 21.

A pressure compensating valve 43 is disposed in the bypass line 22 in series with the bypass valve 21 to maintain a predetermined pressure difference across the bypass valve when the system pressure in the supply conduit exceeds a predetermined level. The pressure compensating valve in the embodiment of FIG. 1 is disposed between the bypass valve 21 and the reservoir 12 and has a biasing means 44 for biasing the valve 43 to the open position shown. The biasing means includes a spring 45 disposed at an end 46 which communicates with the bypass line downstream of the bypass valve 21. The bypass line upstream of the bypass valve communicates with another end 47 through a two-position shut-off valve 48.

An alternate embodiment of the pressure compensating valve 43 shown in FIG. 2 is a pressure reducing valve disposed in the bypass line 22 upstream of the bypass valve 21 and has its end 47 connected to the bypass line upstream of the bypass valve.

FIG. 3 shows another alternate embodiment wherein the biasing means 44 of the pressure compensating valve 43 includes an electronically controlled proportional force generating device 51 that is responsive to an electrical signal 52.

INDUSTRIAL APPLICABILITY

The components of the hydraulic control system are shown in the condition they would assume when no command signals are outputted from the signal generating devices 26,27.

In use, extending the hydraulic actuator 18, for example, is initiated by moving the signal generating device 27 in a first direction an amount corresponding to the desired speed of the actuator. This outputs the command signal 34 to the microprocessor 24 which processes the command signal, produces the control signals 39, 40, and 41 based on data stored in the microprocessor and outputs those control signals substantially simultaneously to the directional control valve 14, the displacement controller 19 and the bypass valve 21. The directional control valve 14 is energized by the control signal 39 and moves upward to establish an area opening commensurate with the control signal so that fluid is fed to the head end of the actuator 18 and fluid exhausted from the rod end is directed to the reservoir. The bypass valve 21 is energized by the control signal 41 and moves downward to decrease the area opening commensurate with the command signal to reduce fluid flow through the bypass line 22. The displacement controller 19 is energized by the control signal 40 and increases the displacement of the pump so that the output flow is sufficient to provide the desired operating speed of the actuator.

Typically, flow rates through the area openings in the directional control valve 14 and the bypass valve 21 is determined by the pressure differential there across. Without the pressure compensating valve 43 disposed in the bypass line 22, the pressure differential across the area opening of the bypass valve would be somewhat dependent upon the system pressure and typically could vary from a low of about 1000 kPa to a high of about 35000 kPa in today's high pressure hydraulic systems.

The pressure compensating valve 43, however, maintains a predetermined pressure differential across the bypass valve when the pressure upstream of the bypass valve exceeds a predetermined value so that the flow rate through the bypass valve is commensurate with the area opening of the bypass valve at system pressures above that level. Typically, the predetermined pressure level is selected so that system pressures below that level have minimal effect on the fluid flow through the area openings.

Referring specifically to the FIG. 1 embodiment, the end 47 of the pressure compensating valve 43 is subjected to the system pressure generated in the supply conduit 16 when the shutoff valve 48 is in the open position while the end 46 is subjected to the pressure in the bypass line downstream of the bypass valve. When the pressure differential across the bypass valve 21 exceeds a predetermined level, as determined by the spring 45, the pressure compensating valve moves downward against the bias of the spring to maintain the predetermined pressure differential across the bypass valve.

The operator can optionally move the shutoff valve to block communication between the supply line 16 and the end 47 of the pressure compensating valve so that the pressure compensating valve remains in the open position. This causes the control system to operate under the operating characteristics of a closed center system.

The pressure compensating valve 43 will also function to maintain the predetermined pressure differential across the bypass valve 21 when the directional control valve 14 is shifted in the other direction, when the directional control valve 13 is shifted in either direction, or if both of the directional control valves are simultaneously shifted.

With reference to the FIG. 2 embodiment, the pressure compensating valve 43 is essentially a pressure reducing valve disposed upstream of the bypass valve 21. The pressure reducing valve functions to reduce the pressure in the bypass line upstream of the bypass valve whenever the pressure in the conduit 16 exceeds the predetermined level.

With reference to the FIG. 3 embodiment, the spring 44 has been replaced with the proportional force exerting device 51 so that the predetermined pressure differential can be controllably adjusted either manually or automatically in response to changes in the hydraulic system operating conditions. For example, as the speed of the engine driving the pump 11 is reduced, the predetermined pressure differential may be reduced in order to reduce bypass flow in proportion to main pump flow.

In view of the above, it is readily apparent that the structure of the present invention provides an improved closed center hydraulic control system which can be operated with the operating characteristics of either a closed center or an open center hydraulic system. This has been accomplished by disposing a pressure compensating valve in the bypass line in series with the bypass valve to maintain a predetermined pressure differential across the bypass valve when the pressure upstream of the bypass valve exceeds a predetermined level and providing a shutoff valve to selectively disable the pressure compensating valve.

Other aspects, objects and advantages of this invention can be obtained from a study of the drawings, the disclosure and the appended claims.

I claim:

1. A hydraulic control system having a pump for delivering pressurized hydraulic fluid from a reservoir, a closed center control valve disposed between the pump and an actuator to control flow of pressurized fluid fed to the actuator, a bypass line connecting the pump to the reservoir, a bypass valve disposed in the bypass line to control fluid flow therethrough and biased to an open flow communicating position, and a controller connected to the control valve and the bypass valve and being operative to controllably move the control valve toward an open, flow communicating position and the bypass valve toward a closed flow blocking position, comprising:

a pressure compensating valve disposed in the bypass line to maintain a predetermined pressure differential across the bypass valve when the pressure upstream of the bypass valve exceeds a predetermined level.

2. The hydraulic control system of claim 1 wherein the pressure compensating valve has first and second ends, and biasing means disposed at the first end for biasing the pressure compensating valve to an open position.

3. The hydraulic control system of claim 2 wherein pressurized fluid from the bypass line upstream of the bypass valve is communicated to the second end of the pressure compensating valve.

4. The hydraulic control system of claim 3 including a shutoff valve disposed to control the flow of pressurized fluid from the bypass line to the second end of the pressure compensating valve.

5. The hydraulic control system of claim 4 wherein the pressure compensating valve is disposed between the bypass valve and the reservoir and the bypass line downstream of the bypass valve communicates with the first end of the pressure compensating valve.

6. The control system of claim 4 wherein the biasing means includes a spring.

7. The control system of claim 2 wherein the biasing means includes an electrically controlled force generating device.

8. The control system of claim 1 wherein the pressure compensating valve is a pressure reducing valve disposed upstream of the bypass valve to reduce the pressure in the bypass line between the pressure compensating valve and the bypass valve to the predetermined pressure level.

* * * * *